United States Patent [19]

Prest et al.

[11] Patent Number: 4,875,951

[45] Date of Patent: Oct. 24, 1989

[54] CHEMICAL FOAMING OF EMULSION EXPLOSIVE COMPOSITIONS

[75] Inventors: David W. Prest, Southport, England; William J. Yorke, Quebec, Canada

[73] Assignee: Imperial Chemical Industries PLC, London, England

[21] Appl. No.: 305,463

[22] Filed: Feb. 2, 1989

[30] Foreign Application Priority Data

Feb. 2, 1988 [GB] United Kingdom ..... 8802209

[51] Int. Cl.[4] ..... D03D 23/00; C06B 45/00

[52] U.S. Cl. ..... 149/109.6; 149/2; 149/44; 149/60; 149/61

[58] Field of Search ..... 149/2, 44, 60, 61, 109.6

[56] References Cited

U.S. PATENT DOCUMENTS 4,409,044 10/1983 Bhattacharyya et al. ..... 149/2
4,507,161 3/1985 Sujansky et al. ..... 149/21
4,594,118 6/1986 Curtin et al. ..... 149/2
4,711,678 12/1987 Ehrnström ..... 149/2
4,737,207 4/1988 Ehrnström et al. ..... 149/2
4,756,776 7/1988 Halliday et al. ..... 149/2
4,790,890 12/1988 Miller ..... 149/2
4,790,891 12/1988 Halliday et al. ..... 149/2

*Primary Examiner*—Edward A. Miller
*Attorney, Agent, or Firm*—Cushman, Darby & Cushman

[57] ABSTRACT

This invention provides an improved method of foaming a water-in-oil emulsion explosive wherein a gassing agent which is a water-in-oil emulsion containing an aqueous solution of sodium nitrite in its discontinuous phase is mixed with the emulsion explosive. The sodium nitrite reacts with ammonium nitrate in the discontinuous phase of the emulsion explosive to generate small particles of gas which are distributed throughout the explosive. The method improves the gas bubble distribution and enhances the sensitivity of the explosive to blasting cap initiation.

5 Claims, No Drawings

CHEMICAL FOAMING OF EMULSION EXPLOSIVE COMPOSITIONS

BACKGROUND OF THE INVENTION

1. Field of the Invention

The present invention relates to a method of manufacturing water-in-oil emulsion explosives which are sensitive to blasting cap initiation. By the term "sensitive to blasting cap initiation" is meant that the explosives may be detonated by a conventional No. 8 detonator.

2. Description of the Prior Art

Water-in-oil emulsion explosives are well known in the explosives art and have been demonstrated to be safe, economic and simple to manufacture and to yield excellent blasting results. Bluhm, in U.S. Pat. No. 3,447,978, disclose the first practical emulsion explosive composition which comprised an aqueous discontinuous phase containing dissolved oxygen-supplying salts, a carbonaceous fuel continuous phase, an occluded gas and an emulsifier. Since Bluhm, further disclosures have described improvements and variations in water-in-oil emulsion compositions. These types of explosives are prepared by emulsifying an organic oxidizer salt which has been dissolved in water with a liquid carbonaceous fuel in the presence of an emulsifying agent. The compositions are commonly sensitized by the incorporation therein of small gas bubbles or by including gas entrapping material. The incorporation of gas bubbles by the in situ chemical generation of gas in the emulsion as a result of the decomposition of a chemical therein is described in, for example, U.S. Pat. Nos. 3,706,607, 3,711,345 and 3,790,415. Generally, the foaming agent is added to the emulsified mixture of the other ingredients, the composition being sufficiently viscous to entrap the gas bubbles when they are generated. U.S. Pat. No. 4,008,180 describes a method of chemically foaming an emulsion explosive by continuously injecting a gas generated material into a stream of the emulsion and thereafter delivering the stream into one or more packaging receivers. The gas generating material thereafter reacts to evolve gas so as to foam the emulsion in the package.

This method, like other similar methods wherein the gas generating chemical is distributed throughout the explosive emulsion by mixing or similar means, is not without disadvantage. In order to achieve wide distribution of the gassing agent, it is essential that the mixing procedure results in a breaking-up of the chemical gassing agent into small particles and distributing these particles throughout the emulsion explosive mass. Since such mixing procedure results in a substantial random distribution of the chemical gassing agent throughout the emulsion, there may be volumes of the emulsion wherein no gassing has occurred. Without adequate distribution of the gas generating material and the gas bubbles provided thereby, the explosive may lack cap sensitivity. In an effort to improve the distribution of the chemical gassing agent, it has been proposed in published South African patent specification No. 85/3253, that a two-component chemical gassing system be employed. In this proposed system, one reactive component is admixed with the carbonaceous fuel phase and a second reactive component is mixed with the aqueous salt phase. The subsequent emulsification of the carbonaceous fuel phase and the aqueous salt phase thereby produced a widely distributed system of gas bubbles throughout the emulsified composition. While this proposal is meritorious, it requires careful control of the amount of the two reactive components in each of the two phases of the emulsion. Furthermore, to achieve suitable distribution of very fine gas bubbles throughout the emulsion, it is necessary that very fine particles of the two reactive components combine at sites distributed throughout the mass.

SUMMARY OF THE INVENTION

The present invention provides an improved method of chemical foaming an emulsion explosive comprised of inorganic oxidizer salt, liquid carbonaceous fuel, water and an emulsifier to form an explosive, the method comprising preparing an emulsion gassing agent in the form of a water-in-oil emulsion wherein the active ingredient of the gassing agent is in the discontinuous phase and adding the said emulsion gassing agent to a prepared water-in-oil emulsion explosive. The gassing agent which is, itself, a water-in-oil emulsion, is distributed through the emulsion explosives by conventional mixing or stirring methods. The active ingredient of the gassing agent reacts with the inorganic oxidizer salt contained in the discontinuous phase of the emulsion explosive to generate small particles of gas which are distributed throughout the emulsion explosive.

DESCRIPTION OF PREFERRED EMBODIMENTS

The active gas generating material that is used in the process of this invention is sodium nitrite. This nitrite, which is contained in the discontinuous phase of the emulsified gassing agent, reacts with the oxidizer salt component which is contained in the discontinuous phase of the emulsion explosive composition. The exact amount of emulsified gassing agent used in the process will vary and the specific amount used will depend upon the final density desired in the resulting product and on the temperature of the formulation when the emulsified gassing agent is added to the emulsion explosive. Generally, amounts ranging from 0.5% to 30% by weight, preferably, 1% to 12% are incorporated into the emulsion explosive mixture. The emulsified gassing agent is added to the emulsion explosives at ordinary mixing temperatures, usually between 48°–77° C., and, preferably, in such a way that the mixture will be sufficiently viscous to retain small gas bubbles when the gassing reaction produces a foam.

The emulsified gassing agent is made in the same manner as a standard emulsion explosive. A desired amount of sodium nitrite and, optionally, metal nitrate salts are dissolved in water to produce an aqueous liquor. This aqueous liquor is slowly added to a blend of oil and surfactant and is thereafter mixed at medium to high shear for several minutes until an emulsion is formed. The sodium nitrite active ingredient is inert as a gas generant until it is added to the emulsion explosives, whereupon it reacts with the ammonium nitrate present in discontinuous phase of the emulsion explosive to generate gas bubbles. The rapidity of the gassing reaction depends upon the degree of mixing, the temperature of the mix, the pH of the medium, the presence of catalysts, etc. The emulsified gassing agent of the invention comprises from 0.5% to 30% by weight of sodium nitrite, from 5% to 90% by weight of water, from 1% to 50% by weight of a carbonaceous liquid and from 1% to 25% by weight of an emulsifier. In addition to its sodium nitrite content, the emulsified gassing agent may also contain other optional ingredients. These include, for example, sodium nitrate, calcium nitrate, finely divided aluminum, dyes, thickeners and bubble stabilizing agents. The proportion of ingredients, preferably, are chosen to approch an overall oxygen balance, i.e., the fuels and oxidizers in the emulsified gassing agent and emulsion explosive are present in just sufficient amounts to react completely. Optionally, the emulsified gassing agent can, itself, be formulated at or near oxygen balances, so that the level of gassing agent can be adjusted during processing to control the amount of gas production without affecting the overall oxygen balance.

In the admixing of the emulsion explosive and the emulsified gassing agent of the invention, advantage is taken of the fact that fluid compositions of similar viscosity may be combined more easily and completely than those having different viscosities. In the method of the present invention wherein two separate water-in-oil emulsions of similar viscosity are combined, this is achieved thoroughly and efficiently with low expenditures of energy.

The following Examples and Tables will illustrate the utility of the present invention.

EXAMPLE I

A number of emulsified gassing agents were prepared containing varying amounts of sodium nitrite and other ingredients. These emulsified gassing agents were admixed with emulsion explosive compositions and thereafter cartridged in packages of 25 mm diameter. The density, the minimum primer and the velocity of detonation (VOD) of each compositions was measured. The composition of the emulsified gassing agent are shown in Table I below.

TABLE I

| Gassing Comp | $NaNO_2$ % wt | $NaNO_3$ % wt | $H_2O$ % wt | $CaNO_3$ % wt | Oil % wt | Surfactant % wt | Additive % wt |
|---|---|---|---|---|---|---|---|
| 1 | 1.7 | 21.1 | 39.9 | 27.3 | 5.0 | 5.0 (1) | 0.01 dye |
| 2 | 2.2 | 22.1 | 29.7 | 36.0 | 5.0 | 5.0 (2) | — |
| 3 | 4.3 | 21.1 | 29.7 | 34.9 | 5.0 | 5.0 (2) | 0.01 dye |
| 4 | 12.7 | — | 52.3 | — | 30.0 | 5.0 (2) | 0.01 dye |
| 5 | 9.8 | — | 55.2 | — | 25.0 | 10.0 (2) | — |
| 6 | 9.8 | — | 54.6 | — | 25.0 | 10.0 (2) | 0.6 agar |
| 7 | 7.8 | — | 56.6 | — | 25.0 | 10.0 (2) | 0.6 agar |
| 8 | 7.8 | — | 57.2 | — | 25.0 | 10.0 (2) | — |
| 9 | 5.9 | — | 58.5 | — | 25.0 | 10.0 (2) | 0.6 agar |
| 10 | 7.8 | — | 57.2 | — | 30.0 | 5.0 (2) | — |
| 11 | 7.8 | — | 57.2 | — | 20.0 | 15.0 (2) | — |
| 12 | 6.5 | — | 57.9 | — | 30.0 | 5.0 (2) | 0.6 agar |
| 13 | 6.5 | — | 57.9 | — | 25.0 | 10.0 (2) | 0.6 agar |
| 14 | 6.5 | — | 57.9 | — | 20.0 | 15.0 (2) | 0.6 agar |
| 15 | 1.3 | 13.3 | 17.8 | 21.6 | 3.0 | 3.0 (2) | 40.0 Al |
| 16 | 1.9 | 9.0 | 12.7 | 15.0 | 2.1 | 2.1 (2) | 57.2 Al |

(1) polymeric surfactant sold by ICI Americas Inc. under the designation B246.
(2) sorbitan mono-oleate The compositions of the emulsion explosives compositions employed in the tests are shown in Table II below.

TABLE II

| | Explosive Emulsions | | |
|---|---|---|---|
| Ingredients % wt | A | B | C |
| Surfactant | 1.7 | 1.9 | 1.9 |
| Carbonaceous fuel | 4.3 | 3.2 | 3.0 |
| Ammonium nitrate | 62.1 | 62.7 | 59.4 |
| Sodium nitrate | 15.0 | 15.2 | 14.4 |
| Calcium nitrate | 4.7 | 4.7 | 4.5 |
| Water | 12.2 | 12.3 | 11.7 |
| Aluminum | — | — | 5.1 |

The results of the testing are shown in Table III below.

TABLE III

| Emul Expl (TABLE II) | Emul % wt | Mix Temp °C. | Gassing Comp (TABLE I) (Col. 1) | Gassing Comp (% wt) | Density g/cc | Primer* | VOD km/s |
|---|---|---|---|---|---|---|---|
| A | 95 | 65 | 1 | 5 | 1.15 | R-8 | 4.5 |
| A | 95 | 65 | 2 | 5 | 1.08 | R-8 | 4.3 |
| C | 93 | 80 | 2 | 7 | 1.17 | R-10 | 3.3 |
| B | 88 | 80 | 15 | 12 | 1.20 | R-11 | 4.3 |
| A | 93 | 80 | 2 | 7 | 1.14 | R-9 | 3.0 |
| A | 97 | 70 | 3 | 3 | 1.08 | R-8 | 4.4 |
| A | 92 | 80 | 16 | 8 | 1.19 | R-8 | 3.9 |
| A | 99 | 70 | 4 | 1 | 1.03 | R-6 | 4.3 |
| A | 99 | 70 | 5 | 1 | 1.07 | R-7 | 4.5 |
| A | 99 | 70 | 6 | 1 | 1.12 | R-7 | 4.6 |
| A | 99 | 70 | 7 | 1 | 1.06 | R-7 | 4.5 |
| A | 99 | 70 | 8 | 1 | 1.10 | R-9 | 4.8 |
| A | 99 | 70 | 9 | 1 | 1.18 | R-11 | 4.6 |
| A | 99 | 70 | 10 | 1 | 1.10 | R-7 | 4.6 |
| A | 99 | 70 | 11 | 1 | 1.09 | R-7 | 4.7 |
| A | 99 | 70 | 12 | 1 | 1.15 | R-11 | 4.7 |
| A | 99 | 70 | 13 | 1 | 1.14 | R-10 | 4.8 |

TABLE III-continued

| Emul Expl (TABLE II) | Emul % wt | Mix Temp °C. | Gassing Comp (TABLE I) (Col. 1) | Gassing Comp (% wt) | Density g/cc | Primer* | VOD km/s |
|---|---|---|---|---|---|---|---|
| A | 99 | 70 | 14 | 1 | 1.15 | R-10 | 4.8 |

*Caps designated R − n contain 0.1 g initiating composition and (n − 3) × 0.05 g PETN.
All properties were measured at 5° C.

An examination of Table III will show that the emulsified gassing composition of the invention, when used with several different explosive composition formulations, provides excellent explosive properties in the final product.

What is claimed is:

1. In a method of chemically foaming an emulsion explosive comprised of oxidizer salt, carbonaceous fuel, water and emulsifier wherein a gas generating material is admixed with the said emulsion explosive to react therein with the evolution of gas to foam the said emulsion explosive, the said gas generating material comprises a water-in-oil emulsion of an aqueous solution of sodium nitrite, a carbonaceous liquid and an emulsifier.

2. A method as claimed in claim 1 wherein the said gas generating emulsion comprises from 0.5% to 30.0% by weight of sodium nitrite, from 5% to 90% by weight of water, from 1% to 50% by weight of a carbonaceous liquid and from 1% to 25% by weight of an emulsifier.

3. A method as claimed in claim 1, wherein the amount of gas generating emulsion employed is from 0.5% to 30% by weight of the total composition.

4. A method as claimed in claim 3 wherein the amount of gas generating emulsion employed is from 1% to 12% by weight of the total composition.

5. A method a claimed in claim 1 wherein the gas generating emulsion also contains additives selected from oxidizer salts, finely divided aluminum, dyes, thickeners and bubble stabilizing agents.

* * * * *